United States Patent [19]

Miura et al.

[11] 4,245,143

[45] Jan. 13, 1981

[54] MICROWAVE OVEN

[75] Inventors: Yoshio Miura; Yukio Fukui; Katunobu Takeda, all of Yokohama, Japan

[73] Assignee: Hitachi Heating Appliances Co., Ltd., Japan

[21] Appl. No.: 33,263

[22] Filed: Apr. 25, 1979

[30] Foreign Application Priority Data

Apr. 28, 1978 [JP] Japan ..... 53/51129
May 24, 1978 [JP] Japan ..... 53/70250[U]

[51] Int. Cl.[2] ..... H05B 9/06
[52] U.S. Cl. ..... 219/10.55 B; 73/355 EM; 219/10.55 F
[58] Field of Search ..... 219/10.55 E, 10.55 F, 219/10.55 R, 10.55 C; 73/355 R, 355 EM; 250/341, 342, 351

[56] References Cited

U.S. PATENT DOCUMENTS

| | | | |
|---|---|---|---|
| 3,784,781 | 1/1974 | Foerstner | 219/10.55 B |
| 3,875,361 | 4/1975 | Fukui et al. | 219/10.55 B |
| 4,049,938 | 9/1977 | Ueno | 219/10.55 R |
| 4,115,680 | 9/1978 | Moore | 219/10.55 B |

*Primary Examiner*—Arthur T. Grimley
*Attorney, Agent, or Firm*—Craig & Antonelli

[57] ABSTRACT

A high frequency heating apparatus is provided with a hood so constructed as to limit infrared ray energy reaching an infrared ray detecting element for detecting infrared rays radiated from an object to be heated within a heating chamber. In heating apparatus, the influence by the reflection of infrared rays is minimized by making the absorption factor approach to about "1" with blackening the inner surface of the hood. Also, the rotation of a chopper to detect infrared rays radiated from the object through chopping operation is detected by a mechanical switch. The output signal from the infrared ray detecting element is synchronous-rectified in synchronism with the switching operation of the mechanical switch.

13 Claims, 12 Drawing Figures

MICROWAVE OVEN

BACKGROUND OF THE INVENTION

The invention relates to a high frequency heating apparatus or a microwave oven with a function for properly heating food stuffs and, more particularly, a high frequency heating apparatus or a microwave oven in which infrared rays radiated from food stuffs within a heating chamber is detected so as to control an optimum time of high frequency heating.

In a conventional high frequency heating apparatus such as a microwave oven, a microwave radiation time is set by using a timer switch in accordance with an instruction described in a cookbook or depending on an experience of a user. However, it is very difficult to always set a proper time. For this, a user frequently sets an improper cooking time so that victuals are dehydrated excessively, resulting in impared taste. When a cooking time set is insufficient, the victuals must be reheated.

With a view of overcoming those problems, there have been many proposals in which infrared rays radiated from food stuffs being cooked are detected and, when the temperature of the food stuffs reaches a proper value, the heating is automatically stopped or is continued for a given time while keeping the temperature of the food stuffs at a proper value. For example, U.S. Pat. No. 4,049,938 to Akihiko Ueno issued Sept. 20, 1977 discloses a microwave oven including infrared ray detecting means for detecting infrared rays from at least two detection points within a heating chamber of the microwave oven. In spite of its complicated electrical circuit construction and expensive parts, the apparatus of this type has poor accuracy in temperature detection as well as in temperature control.

The amount of infrared rays radiated from food stuffs depends on the surface area of the food stuffs as well as the temperature of the same. The amount of infrared rays radiated from the food stuffs increases proportional to the surface area of the food stuffs. If the temperature detection is conducted without taking a proper countermeasure for such surface area dependency, the temperature detected changes depending on the surface area of the food stuffs, thus resulting in poor accuracy in the temperature detection. To solve this problem of the poor accuracy in temperature detection, an infrared detector has been experimented by the inventors which is provided with a cylindrical hood in order to make incident or incoming infrared ray energy constant. However, this attempt has failed to attain an expected effect because of the presence of reflected infrared rays from the hood inner surface. To eliminate the adverse influence of the reflected infrared rays, some approaches have been made such as shortening the diameter of the hood or elongating the length of the hood. When such an approach is employed, however, the incident infrared ray energy decreases so that S/N ratio is deteriorated thus attaining insufficient control.

SUMMARY OF THE INVENTION

Accordingly, an object of the invention is to eliminate the shortcomings mentioned above of the prior arts.

Another object of the invention is to provide a high frequency heating apparatus or a microwave oven which is simple in its electrical circuit construction and inexpensive in cost, with high accuracy in temperature control.

Still another object of the invention is to provide a high frequency heating apparatus which is free from the shortcomings of the prior arts, which has a good S/N ratio, and which can perform an optimum heating by reducing the detection temperature error due to surface area difference of an object to be heated.

DESCRIPTION OF THE PREFERRED EMBODIMENTS

Figure 1:
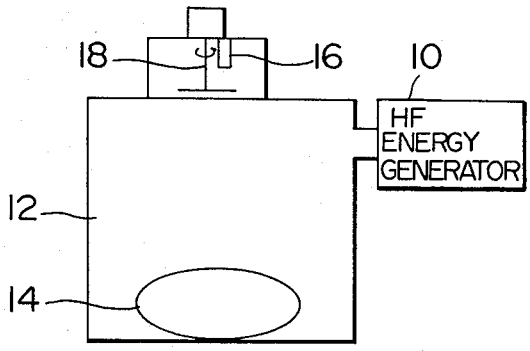
FIG. 1 shows a schematic diagram of a microwave oven to which the present invention is applied.

Referring now to the drawings and particularly FIG. 1, there is shown a simple schematic diagram of a microwave oven. In FIG. 1, an electromagnetic wave radiated from a high frequency energy generator 10, such as a magnetron, heats an object 14 to be heated within an oven heating chamber 12 which forms a metal cavity. When heated the object 14 radiates infrared rays corresponding to the temperature thereof. Means for detecting the infrared rays, for example, an infrared ray detector 16 is disposed above the oven 12 and the output signal from the infrared ray detector 16 is used to control the operation of the microwave generator 10. A chopper 18 periodically interrupts infrared rays and the interrupted infrared rays enter the infrared ray detector 16. The infrared ray detector may be, for example, a pyroelectric infrared ray detecting element, a thermocouple, a thermistor and the like.

Figures 2A, 2B, 2C:
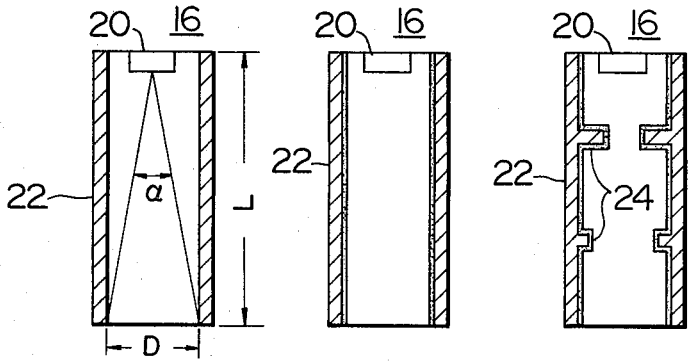
FIG. 2A shows a cross-sectional view of a infrared ray detecting element hood which has been proposed in the process of the invention.
FIGS. 2B and 2C show cross-sectional views of infrared ray detecting element hoods according to the invention.

Some embodiments of the detector 16 are illustrated FIGS. 2A, 2B and 2C. The detector shown in FIG. 2A has a construction in which, as described above, an infrared ray detecting element 20 is disposed within a cylindrical hood 22 for the purpose of making the incoming or incident infrared ray energy constant. In this case, as shown in a graph B in FIG. 3, the shortcoming is improved to some extent but is insufficient in its improvement, as seen when it is compared with a case where no special hood is provided for covering the infrared ray detecting element, as shown by a graph (A) in FIG. 3. In the case of the graph (A), namely, since the infrared ray detecting element 20 is not covered with the hood, the amount of infrared rays is proportional to the surface area of the object 14. In the case of using the hood 22 as shown in FIG. 2A, however, the object surface area versus incident infrared ray energy characteristic is improved such that, when the surface area of the object exceeds $S_1$, the incident energy is kept substantially constant, as shown by the graph (B). The poor improvement is attributed to the existence of the infrared rays reflected at the inner surface of the hood 22. Trial has been made to reduce the diameter D of the hood 22 or to elongate the length L of the same. This attempts, however, suffer from the above mentioned disadvantages.

Namely, the disadvantage of FIG. 2A is due to the fact that not only the infrared energy from the surface area of the food determined by the opening angle $\alpha$ shown in FIG. 2A, but also the infrared energy from portions other than the area determined by the opening angle $\alpha$ are entered the infrared ray detecting element 20 by being reflected from the inner wall of the hood 22.

FIGS. 2B and 2C show preferable embodiments of the invention.

As shown in FIG. 2B, the inner wall of the hood 22 may be coated with blackening material, such as a carbon black, thereby to make the absorption factor approach to "1" so that the reflection of the infrared rays from the inner surface may be prevented so that the characteristic is improved compared to the case shown in FIG. 2A and therefore the incident infrared energy onto the detecting element 20 kept constant beyond the object surface area $S_2$ which is smaller than $S_1$.

Figure 3:
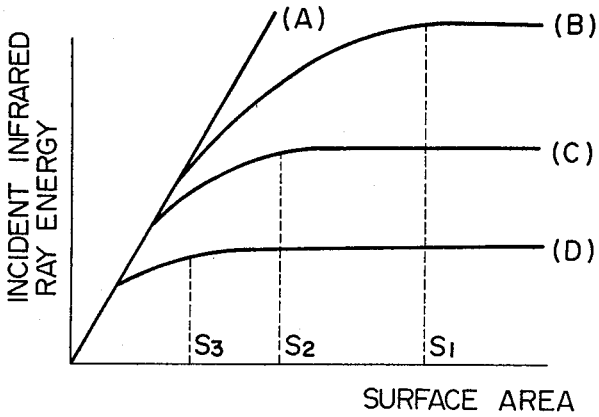
FIG. 3 shows graphs illustrating relations between incident infrared ray energy to an infrared ray detecting element with the surface area of an object to be heated.

Further, the hood may preferably be provided on the inner wall thereof with ring-like flange means 24 for preventing the infrared rays reflected on the inner wall of the hood from passing therethrough, so that the influence by the reflected rays may be more effectively removed, as shown by the graph (D) shown in FIG. 3. It will be appreciated that the shape of the hood 22 is not limited to the cylindrical one. When a plurality of ring-like flanges are provided as shown in FIG. 2C, it is preferable to make the respective diameters of the central openings of the flanges different from each other.

Figure 4:
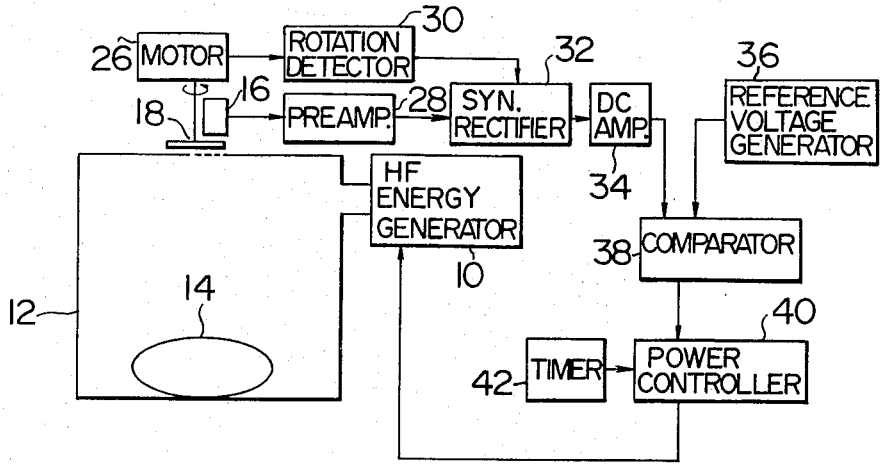
FIG. 4 shows a block diagram of a control circuit of a microwave oven which is an embodiment according to the invention.

Turning now to FIG. 4, there is shown another embodiment of a microwave oven according to the invention. In the figure, like numerals are used to designate like portions or equivalent portions shown in FIG. 1. The circuit construction to control the operation of a microwave generator 10 will be described. The infrared rays emitted from the object 14 are periodically interrupted by a chooper 18 driven by a motor 26, and the interrupted infrared rays are entered into an infrared ray detector 16. The detector 16 produces an AC electric signal with an amplitude proportional to the amount of incident infrared rays thereto and applies it to a preamplifier circuit 28 to be amplified thereby. The output signal from the circuit 28 is synchronous-rectified by a synchronous rectifier circuit 32 in response to synchronizing signal derived from a rotation detecting circuit 30, and then is subjected to a DC amplification by a DC amplifier circuit 34. The voltage from the DC amplifier circuit 34 is compared, by means of a comparing circuit 38, with a DC voltage which is set by a reference voltage generating circuit 36 in accordance with a desired temperature. The output signal from the comparing circuit 38 turns on or off a power control circuit 40 comprised of a relay or a thyristor. Therefore, merely by setting the voltage of the comparing voltage generating circuit 36 to a proper value, the microwave oven may be controlled at a desired heating temperature value. When the object 14 is heated for a given time, a timer for setting a heating time is set and the ON-OFF operation of the microwave generator 10 is repeated for the time set.

Figure 5A:
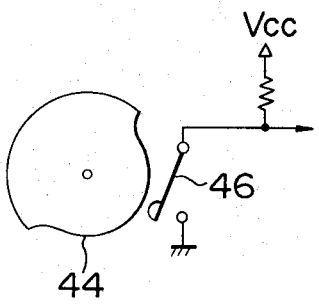
FIGS. 5A, 5B, 7 and 8 show examples various embodiments of means for producing a synchronizing signal according to the invention.
Figure 5B:
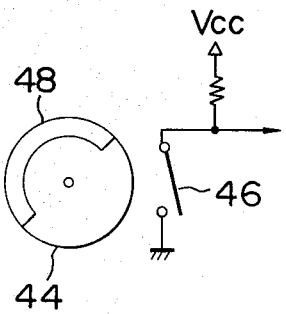
Figure 6:
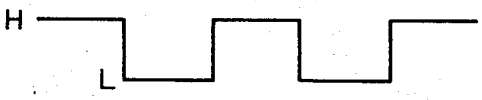
FIG. 6 shows a waveform of the synchronizing signal.
Figure 7:
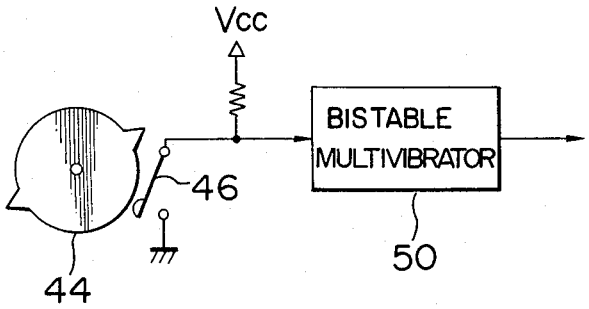
Figure 8:
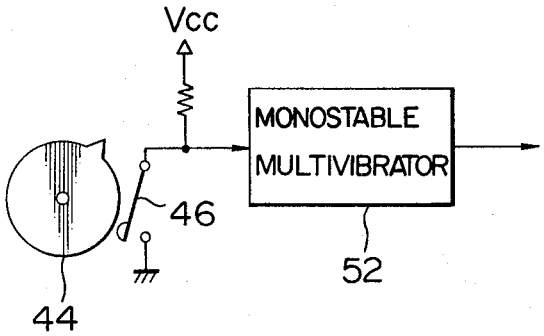

How to produce the synchronizing signals from the rotation detecting circuit 30 will be described with reference to FIGS. 5 to 8. In FIGS. 5A and 5B, a disc 44 is coupled with a motor 26 rotates with the same rotation number as that of the chooper 18. In the case of FIG. 5A, a cam-switch structure is employed for the disc 44 to turn on and off a switch 46 coupled with a power source Vcc to produce synchronizing signals as shown in FIG. 6. In the case of FIG. 5B, a magnet 48 is provided extending partially around the disc 44 and the switch 46 is turned on and off by the magnet to produce synchronizing signals. An embodiment of FIG. 7 employs the combination of a cam-switch structure and a bistable multivibrator and an embodiment of FIG. 8 employs the combination of a cam-switch structure and a monostable multivibrator 52.

Either the cam-switch or the magnet on the disc as displaced such that the synchronizing signal which is obtained in such a manner as described above serves as an ON signal (or OFF signal) for the period during which the infrared ray detector 16 receives infrared rays while it serves as an OFF signal (or ON signal) for the period during which the infrared rays are shut out by the chopper wing 18.

Figure 9:
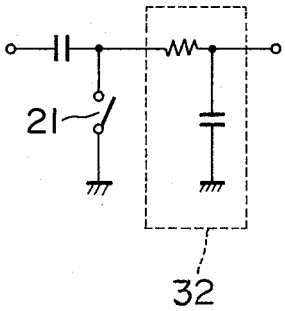
FIG. 9 shows a synchronizing rectifier circuit.

FIG. 9 shows an example of the synchronous rectifier circuit 32. In a conventional synchronous rectifying circuit, a transistor, or a FET transistor, etc. is employed alternatively for the switch 21 of FIG. 9 and the transistor or FET transistor is rendered on/off in response to the synchronizing signal obtained by a synchronizing signal generating circuit to thereby effect the synchronizing rectification and the thus synchronous rectified output is smoothed by a low-pass filter disposed at the next stage.

On the contrary, according to the present invention, since the synchronizing signals are produced in such a manner as shown in either FIG. 5A or FIG. 5B, the ON-OFF operation of the switch 46 may be regarded as the ON-OFF synchronizing signals respectively. Accordingly, in FIG. 4, the switch 46 may be used not only for the detection of rotation speed in the rotation detector circuit 30 but also for the switch element of the synchronizing circuit 32. There is such an advantage that the switch is used in common as the rotation detection circuit 30 shown in the block diagram of FIG. 4 as well as the rectifier switch of the synchronous rectifying circuit 32.

It will be understood that the rotation detect-means is not limited to those shown in FIGS. 5A, 5B, 7 and 8, but other suitable means such as optical or magnetic means is also applicable.

As described above, the incident infrared ray energy to the detector may be made kept constant, even though the surface area of food differs, by placing the infrared ray detector in a hood having the blackened inner wall and more preferrably provided with ring-like flange means for preventing the infrared rays reflected on the hood inner wall from passing therethrough. Further, a temperature detecting error due to difference of the food surface area may be considerably reduced. Additionally, since S/N ratio is not deteriorated, the microwave radiation time may be controlled very stably.

Furthermore, the synchronizing signal generating circuit or the synchronizing rectifier circuit is very simple in the construction, that is to say, it needs at most one switch without the use of an expensive motor, for example, a servo motor.

The microwave oven according to the invention employs a scheme in which synchronizing signals are directly taken out from the rotation of the chopper. Therefore, the microwave oven is free from a variation of the output synchronizing signals due to a variation of the mounting position of the chopper.

What is claimed is:

1. A microwave oven comprising:

a heating chamber for heating an object to be heated therein;

means for producing high frequency energy and guiding it into said heating chamber;

means for detecting the amount of incoming infrared ray energy;

hood means provided on said infrared ray energy amount detecting means, for controlling the amount of infrared ray energy radiated from the object to be heated within said heating chamber to be received by said infrared ray energy amount detecting means;

means for limiting the amount of infrared ray energy which is incident upon the inner wall of said hood means and reflected therefrom to be received by said infrared ray energy amount detecting means; and means for controlling the output of said high frequency energy generating and guiding means in response to the output of said infrared ray energy amount detecting means.

2. A microwave oven comprising;

a heating chamber for heating an object to be heated therein;

means for producing high frequency energy and guiding it into said heating chamber;

means for detecting the amount of incoming infrared ray energy;

chopper means disposed in a path of infrared rays traveling from the object to said infrared ray energy amount detecting means for chopping the infrared rays passing therethrough;

switch means for achieving on-off operation in synchronism with the rotation of said chopper means;

means for synchronous-rectifying the output of said infrared ray energy amount detecting means in response to the on-off operation of said switch means; and means for controlling the output of said high frequency energy generating means in response to the output of said synchronous rectifying means.

3. A microwave oven according to claim 1, in which said means for controlling the output of said high frequency energy generating and guiding means compries chopper means which is disposed on a path of infrared rays traveling from the object to said infrared ray energy amount detecting means, for chopping the infrared rays passing therethrough, switch means for achieving on-off operation in synchronism with the rotation of said chopper means, means for synchronous-rectifying the output of said infrared ray energy amount detecting means in response to the on-off operation of said switch means, and means for controlling the output of said high frequency energy generating means in response to the output of said synchronous rectifying means.

4. A microwave oven according to claim 1 or 3, in which said infrared ray energy amount limiting means comprises a material applied on the inner surface of said hood means to blacken said inner surface.

5. A microwave oven according to claim 4, in which said infrared ray energy amount limiting means further comprises means provided on said hood means for preventing the infrared rays reflected on the hood inner wall from passing therethrough.

6. A microwave oven according to claim 5, in which said reflected infrared ray preventing means includes at least one ring-like flange mounted on said hood inner wall and extended vertically and inwardly therefrom, said flange being provided at its center with a circular opening allowing the infrared rays to pass therethrough.

7. A microwave oven according to claim 6, in which said reflected infrared ray preventing means comprises a plurality of said flanges respectively having their central circular openings with diameters different from each other.

8. A microwave oven according to claim 2 or 3, in which said switch means includes cam means fixed to rotary shaft of said chopper means so as to rotate with said shaft, and a switching device disposed in contact with a peripheral edge of said cam means, for effecting said on-off operation in synchronism with the rotation of said chopper means, said synchronous rectifying means being arranged to respond to the on-off operation of said switching device.

9. A microwave oven according to claim 8, in which said cam means is provided on its peripheral edge with one projection, said switching device being actuated by said projection to produce an output signal, said switch means including a monostable multivibrator driven by the output signal of said switching, said synchronous rectifying means being actuated to operate by an output signal of said monostable multivibrator.

10. A microwave oven according to claim 8, in which said cam means is provided on its peripheral edge with two projections, said switching device being actuated by each of said projections to produce an output signal, said switch means including a bistable multivibrator driven by the output signal of said switching device, said synchronous rectifying means being actuated to operate by an output signal of said bistable multivibrator.

11. A microwave oven according to claim 2 or 3, in which said switch means includes a disc fixed to a shaft of said chopper means so as to rotate with said shaft, a magnet provided on a part of a peripheral edge of said disc, and a switching device provided adjacent to the peripheral edge of said disc and being responsive to the presence of said magnet close thereto so as to effect the on-off operation in synchronism with the rotation of siad chopper means, said synchronous rectifying means being actuated by the on-off operation of said switching device.

12. A microwave oven according to claim 2 or 3, in which said means for controlling the output of said high frequency energy generating and guiding means further comprises adjustable reference voltage generating means, means for comparing the output of said synchrous rectifying means with the output of siad reference voltage generating means, and means re ponsive to the output of said comparing means to control electric energy externally applied to enrgize said high frequency energy generating and guiding means.

13. A microwave oven according to claim 12, in which said means for controlling the output of said high frequency energy generating and guiding means further comprises timer means connected to said means for controlling the externally applied electric energy, for controlling the operation of said externally applied electric energy control means.

* * * * *